US007594518B2

(12) United States Patent
Issagholian-Havai

(10) Patent No.: US 7,594,518 B2
(45) Date of Patent: Sep. 29, 2009

(54) VANE ASSEMBLY FOR HVAC DUCT SYSTEMS

(76) Inventor: Robert Issagholian-Havai, 5119 Azusa Canyon Rd., Baldwin Park, CA (US) 91706

( * ) Notice: Subject to any disclaimer, the term of this patent is extended or adjusted under 35 U.S.C. 154(b) by 842 days.

(21) Appl. No.: 11/025,629

(22) Filed: Dec. 29, 2004

(65) Prior Publication Data

US 2006/0199502 A1 Sep. 7, 2006

(51) Int. Cl.
*F15D 1/04* (2006.01)

(52) U.S. Cl. ..... 138/37; 138/39; 137/561 A; 29/513

(58) Field of Classification Search ..... 138/39, 138/37; 137/561 A; 29/513
See application file for complete search history.

(56) References Cited

U.S. PATENT DOCUMENTS 2,292,246 A * 8/1942 Steffens ..... 138/39
2,297,979 A * 10/1942 Peck ..... 138/39
2,359,579 A * 10/1944 Peck ..... 138/37
2,826,221 A * 3/1958 Speiser ..... 138/39
3,381,713 A * 5/1968 Jacobsen ..... 138/39
3,405,737 A * 10/1968 Harper ..... 138/39
3,455,008 A * 7/1969 Harper ..... 29/722
3,602,262 A * 8/1971 Hinden ..... 138/39
4,467,829 A * 8/1984 Myers ..... 137/561 A
4,586,540 A * 5/1986 DeLord ..... 138/39
4,641,684 A * 2/1987 DeLord ..... 137/561 A
4,911,205 A * 3/1990 Myers ..... 138/39
5,529,092 A * 6/1996 Arnoldt ..... 138/39
5,927,339 A * 7/1999 Ellis et al. ..... 138/39
6,244,300 B1 * 6/2001 Pacana ..... 138/39

* cited by examiner

*Primary Examiner*—Patrick F Brinson
(74) *Attorney, Agent, or Firm*—Tod R. Nissle, P.C.

(57) ABSTRACT

A vane system is provided for use in a corner of a HVAC duct system. The vane system utilizes a plurality of unitary vanes each including ribs and each including interlocking runners that improve the structural integrity of the vane system.

5 Claims, 8 Drawing Sheets

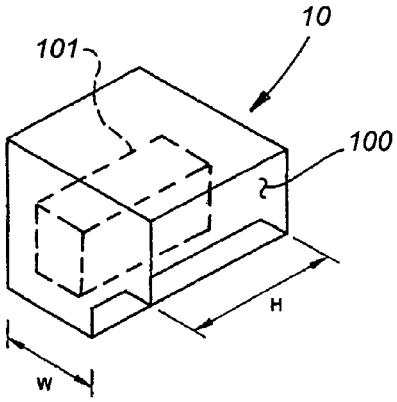
FIG. 1 : PRIOR ART
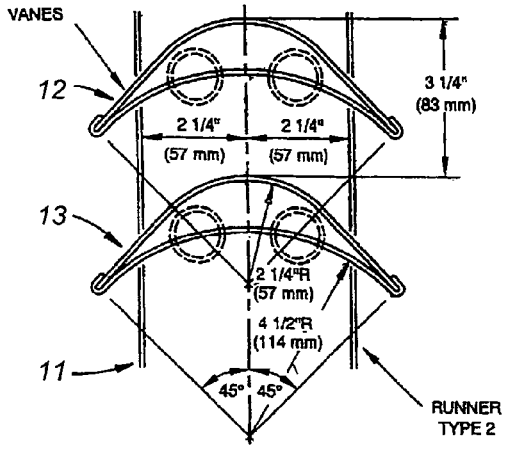
FIG. 2 : PRIOR ART
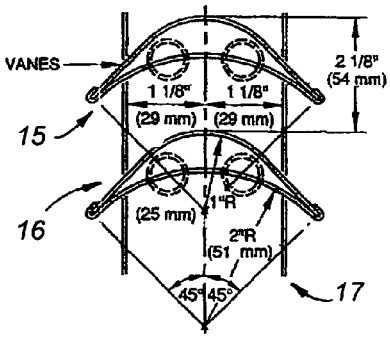
FIG. 3 : PRIOR ART
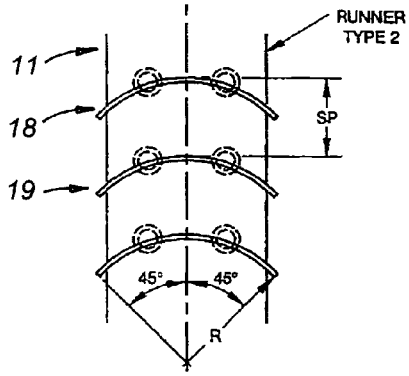
FIG. 4 : PRIOR ART

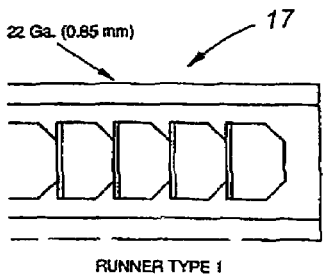
FIG. 5: PRIOR ART
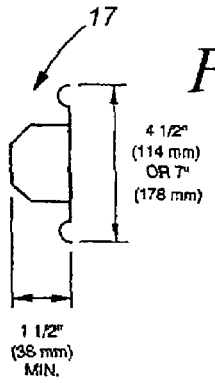
FIG. 6: PRIOR ART
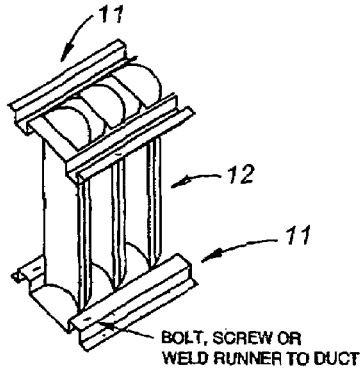
FIG. 7: PRIOR ART
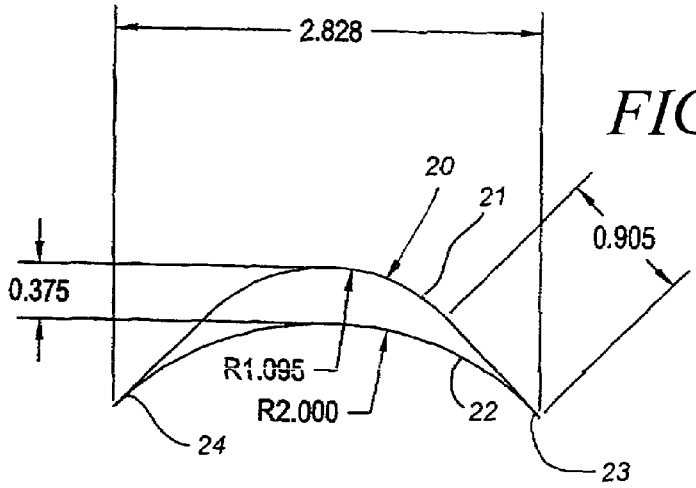
FIG. 8

VANE ASSEMBLY FOR HVAC DUCT SYSTEMS

This invention pertains to heating, ventilation, and air conditioning (HVAC) duct systems that utilize components fabricated from sheet metal and other panel material.

More particularly, the invention pertains to a vane assembly that includes a plurality of spaced apart parallel vanes and that is incorporated in a HVAC duct system to direct the flow of air around a corner in the duct system.

In a further respect, the invention pertains to a vane assembly that, once constructed, is unlikely to come apart, that maintains a desired parallel relationship between vanes in the system, and that prevents vane ends from twisting.

The use of vane assemblies in HVAC duct systems is well known. Such vane assemblies are used to smoothly direct a stream of air around an "elbow" or corner in the HVAC duct system. One typical hollow duct elbow 10 is, by way of example, illustrated in FIG. 1. Conventional vane assemblies include a plurality of arcuate spaced apart vanes 12, 13 mounted on and intermediate a pair of parallel, spaced apart runners 11. The size of the vanes and accompanying runners can vary as desired. The vanes 15 and 16 in FIG. 3 are smaller than vanes 12, 13. The runners 17 (FIGS. 5 and 6) used in combination with vanes 12, 13 are smaller than runners 11. Vanes 12, 13, 15, 16 each consist of a pair of arcuate metal pieces. In contrast, vanes 18 and 19 in FIG. 4 each consist of a single arcuate piece of metal. As is indicated in FIG. 7, the upper and lower ends of conventional vanes 12 are typically bolted, screwed, or welded to runners 11.

One disadvantage of conventional vane assemblies of the type set forth in FIGS. 1 to 7 is that the vane ends tend to come apart from the runners, particularly when a "button punch" is used. Another disadvantage of conventional vane assemblies is that bolting, screwing, or welding each end of a vane to its associated runner is time consuming. A further disadvantage of conventional vane assemblies is that two-piece vanes of the type illustrated in FIGS. 2 and 3 tend to slide and the ends of the vanes tend to twist.

Accordingly, it would be highly desirable to provide an improved vane assembly that reduces the time required to assemble the vane system, and that reduces the likelihood that the vane system will come apart lose its desired configuration.

Therefore, it is a principal object of the instant invention to provide an improved vane assembly for use in directing air flow through a corner in a HVAC duct assembly.

Another object of the invention to provide an improved vane assembly that does not require vanes to be bolted, screwed, or welded to their associated runners.

A further object of the invention is to provide an improved vane system that maintains its structural integrity.

These and other, further and more specific objects and advantages of the invention will be apparent from the following detailed description of the invention, taken in conjunction with the drawings, in which:

FIG. 1 is a perspective view illustrating a conventional rectangular corner utilized in a conventional HVAC duct assembly;

FIG. 2 is a top view illustrating a pair of conventional vanes positioned with respect to a runner attached to the lower ends of the vanes;

FIG. 3 is a top view illustrating another pair of conventional vanes positioned with respect to a runner attached to the lower ends of the vanes;

FIG. 4 is a top view illustrating a further pair of conventional vanes positioned with respect to a runner attached to the lower ends of the vanes;

FIG. 5 is a top view illustrating a runner of the type utilized in FIG. 3;

FIG. 6 is an end view further illustrating the runner of FIG. 5;

FIG. 7 is a perspective view illustrating a conventional vane system consisting of parallel, spaced apart vanes each having an upper end attached to one runner and a lower end attached to another runner;

FIG. 8 is a top view generally illustrating an end of a unitary vane constructed in accordance with the invention;

Figure 9:
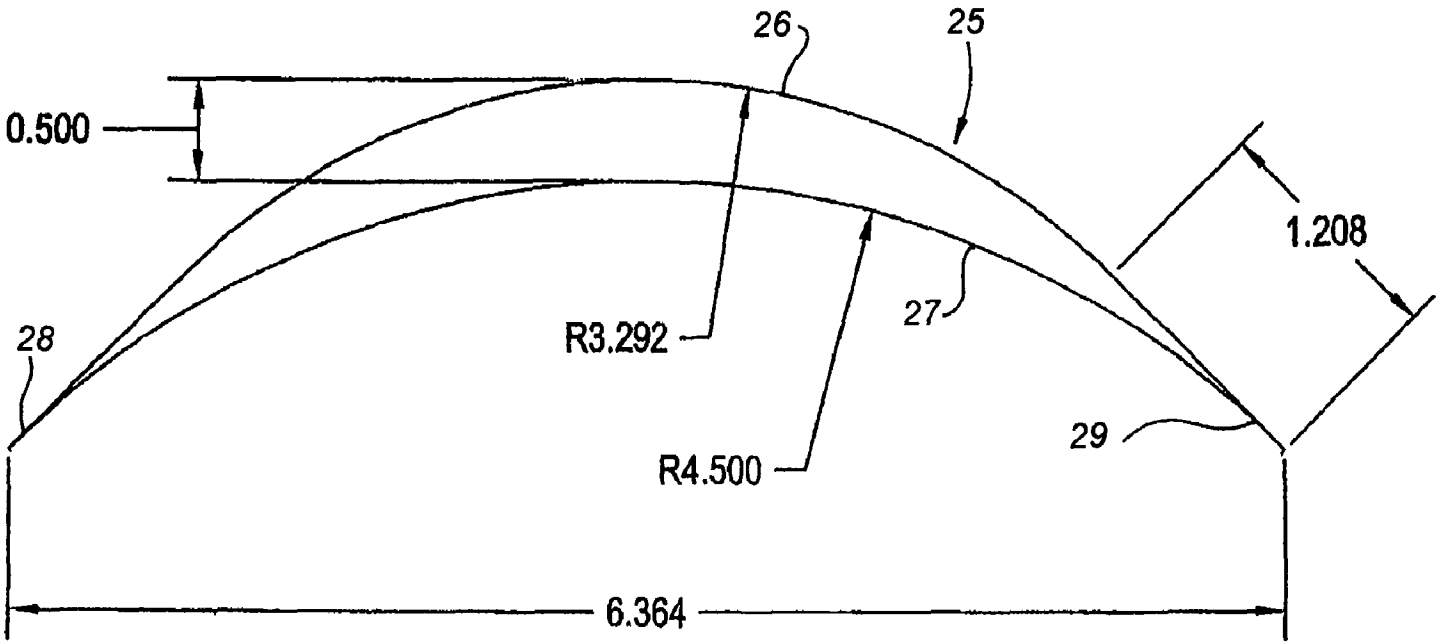
FIG. 9 is a top view generally illustrating an end of a unitary vane constructed in accordance with the invention.

Briefly, in accordance with my invention, I provide improvements in combination with a corner in a duct in a HVAC assembly. The improvements direct a flow of air through the corner and comprise a vane system. The vane system includes a plurality of unitary vanes each including at least one arcuate wall with a pair of sides; an upper end; a lower end; and, at least one rib intermediate the sides and extending intermediate the ends. The vane system also includes a first runner connected to the upper ends of the vanes; and, a second runner connect to the lower ends of the vanes.

In another embodiment of the invention, I provide a vane system for use in a corner in a duct in a HVAC assembly to direct a flow of air through the corner, the vane system comprises a plurality of unitary vanes each including at least one arcuate wall with a pair of sides; an upper end; a lower end; and, at least one rib intermediate the sides, extending intermediate the ends, and including at least one aperture formed therethrough. The vane system also includes a first runner connected to the upper ends of the vanes and including a plurality of tongues. Each of the tongues extends along a different one of the vanes and has at least one tooth extending through and interlocking with the aperture in the one of the vanes. The vane assembly also includes a second runner connected to the lower ends of the vanes.

In a further embodiment of the invention, I provide a method for constructing a vane system for use in a corner in a duct in a HVAC assembly to direct a flow of air through the corner. The method includes the step of providing a plurality of unitary vanes each including at least one arcuate wall with a pair of sides; an upper end; a lower end; and, at least one rib intermediate the sides, extending intermediate the ends, and including at least one aperture formed therethrough. The method also includes the steps of providing a first runner including a plurality of spaced apart tongues each having at least one tooth, the tongue shaped and dimensioned to slidably insert in one of the vanes such that the tooth extends through and interlocks with the aperture in the one of the vanes; providing a second runner; connecting the lower ends of the vanes to the second runner; and, sliding each of the tongues of the first runner into a different one of the vanes such that the tooth on each of the tongues interlocks with one of the apertures.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 8 generally illustrates a vane constructed in accordance with the invention and generally indicated by reference character 20. The vane 20 includes a first arcuate portion 21 and a second arcuate portion 22. Portions 21 and 22 co-terminate at ends 23 and 24. The units of measure for the numbers shown in FIG. 8 (i.e., 2.828, 0.375, etc.) is inches.

FIG. 9 generally illustrates a vane constructed in accordance with the invention and generally indicated by reference character 25. The vane 25 includes a first arcuate portion 26 and a second arcuate portion 27. Portions 26 and 27 co-terminate at ends 28 and 29. The units of measure for the numbers shown in FIG. 9 (i.e., 0.500, 1.208, etc.) is inches.

Figure 10:
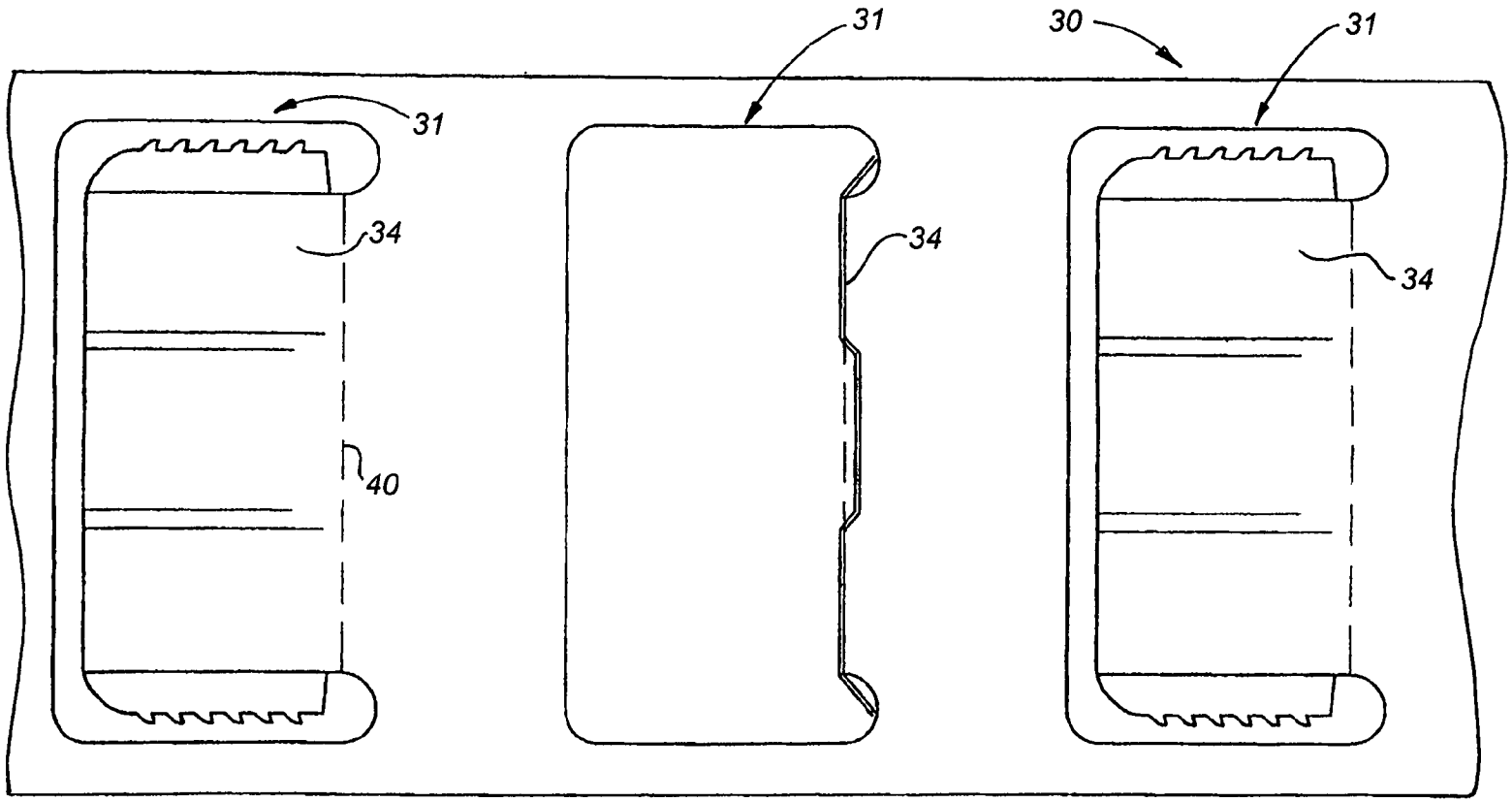
FIG. 10 is a top view illustrating a runner constructed in accordance with invention.

FIG. 10 illustrates a runner 30 constructed in accordance with the invention and including a plurality of tongues 34 each extending into an opening 31 formed through runner 30. Since runner 30 is typically, although not necessarily, produced from sheet metal, openings 31 are usually formed with a punch in a flat panel shaped piece of material. The middle tongue 34 in FIG. 10 has been bent upwardly along a fold line 40 such that the middle tongue is normal to the plane of the sheet of paper of the drawing and is normal to runner 30. Prior to using runner 30, each of the remaining tongues 34 is bent along fold line 40 to a position normal to the plane of the sheet of paper of the drawing.

Figure 12:
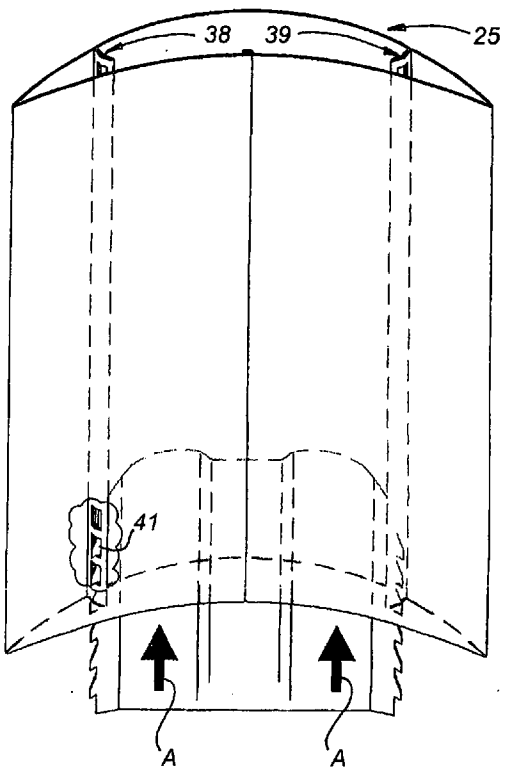
FIG. 12 is a perspective view illustrating the runner tongue of FIG. 11 being inserted in interlocking engagement with the vane of FIG. 11.
Figure 11:
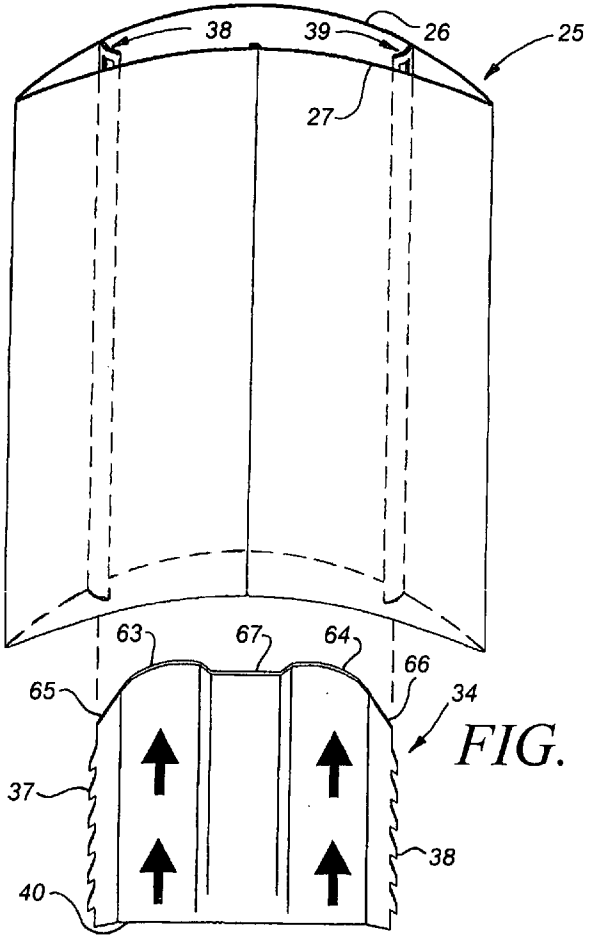
FIG. 11 is a perspective view illustrating a runner tongue in position to be inserted in one end of a vane.

The ribs 38, 39 provided in each vane 25 are illustrated in FIG. 11, as are the apertures 41 formed through each rib 38, 39. Apertures 41 are spaced apart from portion 26 of vane 25. Each tongue 34 includes one wing or flange 65 provided with teeth 37 and a second wing or flange 66 provided with teeth 38. Tongue 34 also includes panel sections 63, 64, 67. FIG. 11 illustrates tongue 34 prior to its being slid into vane 25. In FIG. 12, tongue 34 is in the process of being slid into vane 25 in the direction of arrows A such that each tooth 37 interlocks with an aperture 41.

Figure 14:
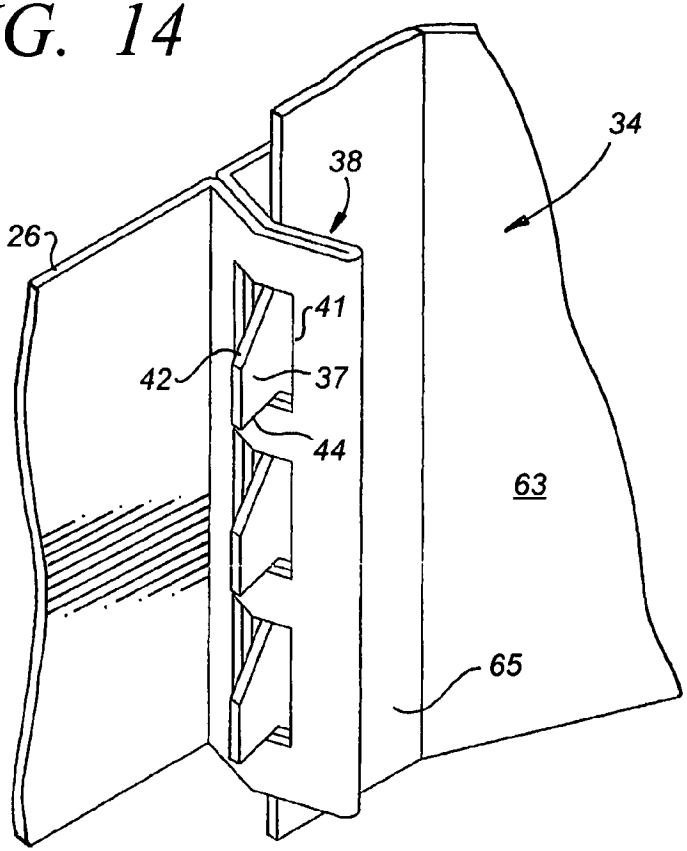
FIG. 14 is a perspective view illustrating the runner tongue teeth in interlocking engagement with the openings in the vane ribs.
Figure 13:
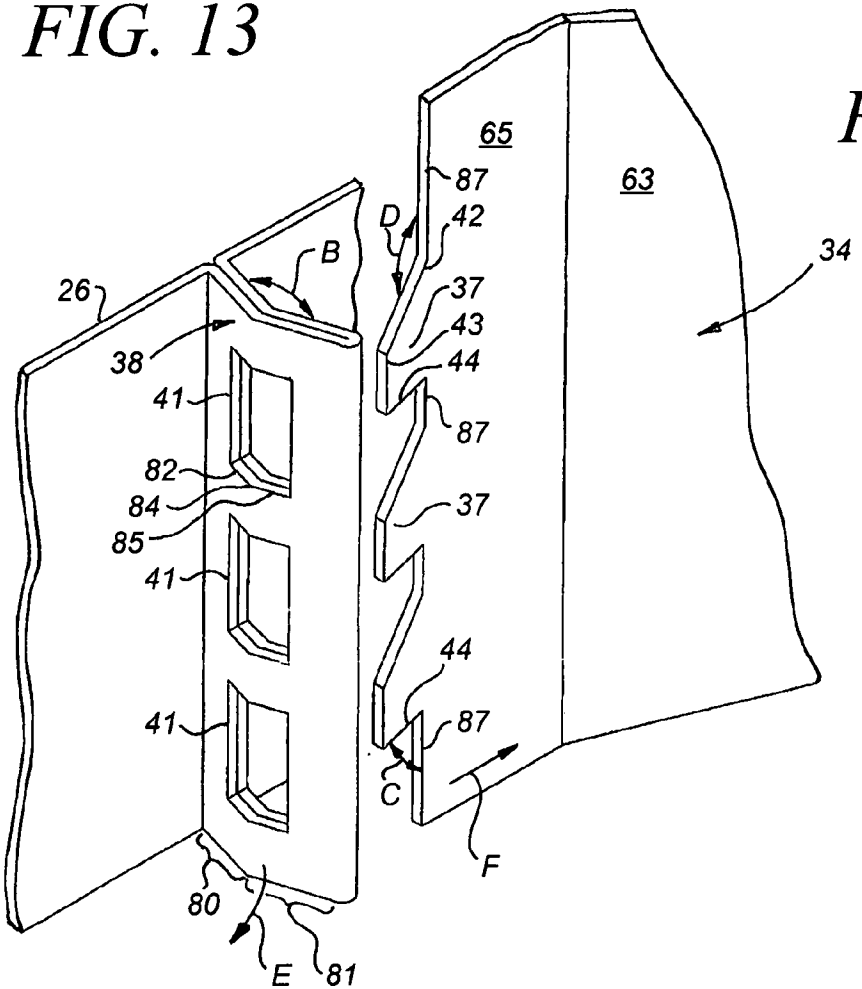
FIG. 13 is a perspective view illustrating the teeth on the runner tongue and the openings in the vane ribs.

The presently preferred configuration of ribs 38 and 39, of apertures 41 formed through ribs 38 and 39, and of teeth 37 is more specifically illustrated in FIGS. 13 and 14. Each rib 38 includes a base portion 80 and a leg portion 81. The angle B between portions 80 and 81 can be varied as desired but preferably is less than one hundred and eighty degrees and, consequently, tends to form at the juxtaposition of portion 80 and 81 a "V" groove that opens toward teeth 37 and along which the outer edges 43 of teeth 37 slide when tongue 34 is being slidably inserted along a vane 25. The bottom edges 82, 85 of each aperture 41 slope downwardly to a juxtaposition 84 to also form a "V" groove. The lower edge 44 of a tooth 37 seats at juxtaposition 84 in the manner illustrated in FIG. 14 when tooth 44 extends through aperture 41.

Upper sloped edge 42 of tooth 37 is at an angle D to vertical edge 87 that is greater than ninety degrees, preferably is greater than one hundred ten degrees, and most preferably is greater than one hundred and thirty-five degrees. This sloped edge 42 facilitates the sliding of teeth 37 along a rib 38, 39 when tongue 34 is inserted in a vane 25. In contrast, the lower edge 44 of a tooth 37 is preferably at an angle C from vertical edge 87 that is less than ninety degrees. Edge 87 is generally parallel to rib 38. When edge 44 is at an angle C that is less than ninety degrees, once tongue 34 is inserted in a vane 25 and teeth 37 each extend through an aperture 41, attempting to withdrawn tongue 34 in a direction opposite of that arrow B from vane 25 only functions to better seat in the juxtaposition 84 of each aperture 41 the portion of tooth 37 at the function of lower edge 44 and vertical edge 87. Pulling tongue 34 in a direction opposite that of arrow B generates a force that function to force lower edge 44 into aperture 41 and through its associated aperture 41 in the direction indicated by arrow T in FIG. 14.

When tongue 34 is being slid into a vane 25, vane 25 and/or tongue 34 resiliently deform to permit outer edges 43 to slid along rib 38 (or 39) until each tooth 37 is lodged in and extends through its associated desired aperture 41 and is in the position illustrated in FIG. 14. One way vane 25 can resiliently deform is by permitting edges 43 to displace a rib 38 in a direction E outwardly away from teeth 37. After each tooth 37 is lodged, or "snaps into" in an aperture 41, rib 38 resiliently moves in a direction opposite that of arrow E back to its normal position and orientation in vane 25. Or, tongue 34 can resiliently deform by flexing inwardly in the direction of arrow F. After each tooth 37 is seated in an aperture 41 in the manner illustrated in FIG. 14, tongue 34 can "unflex" and resiliently move in a direction opposite that of arrow F back to the normal configuration illustrated in FIGS. 14, 11, 15. Vane 25 and/or tongue 34 can be configured and constructed in any desired manner that permits tongue 34 to be slidably inserted in vane 25 in the manner illustrated in FIGS. 11 to 17.

Figure 15:
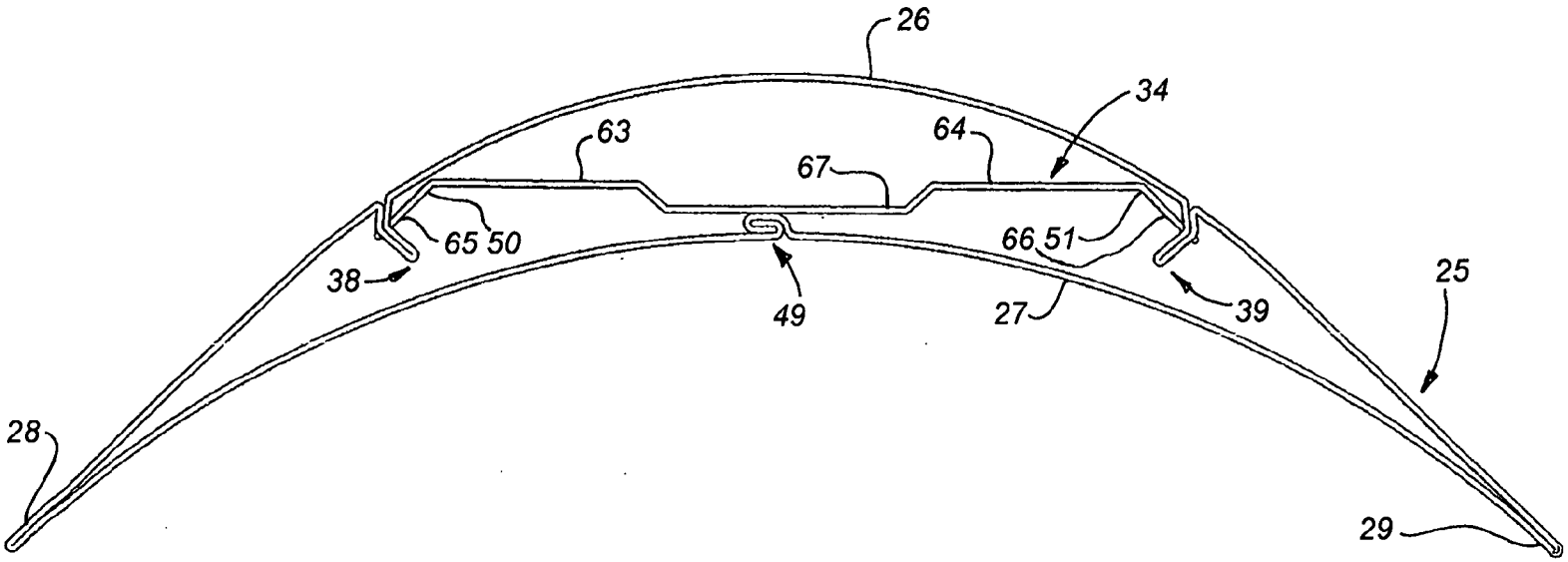
FIG. 15 is a view of one end of a vane further illustrating the runner tongue inserted in interlocking engagement with the other end of the vane.
Figure 16:
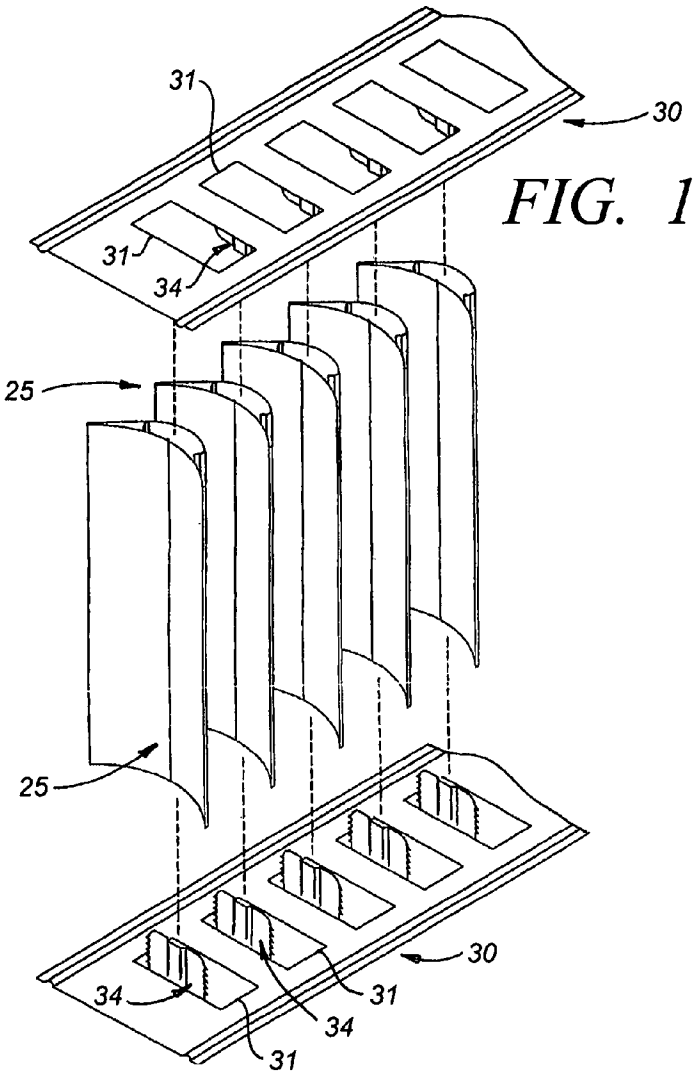
FIG. 16 is an exploded perspective view illustrating vanes constructed in accordance with the invention positioned to be assembled with a pair of runners each positioned at the top or bottom of the vanes; and, FIG. 17 is a perspective view illustrating the runners and vanes of FIG. 16 in the completed vane assembly.
Figure 17:
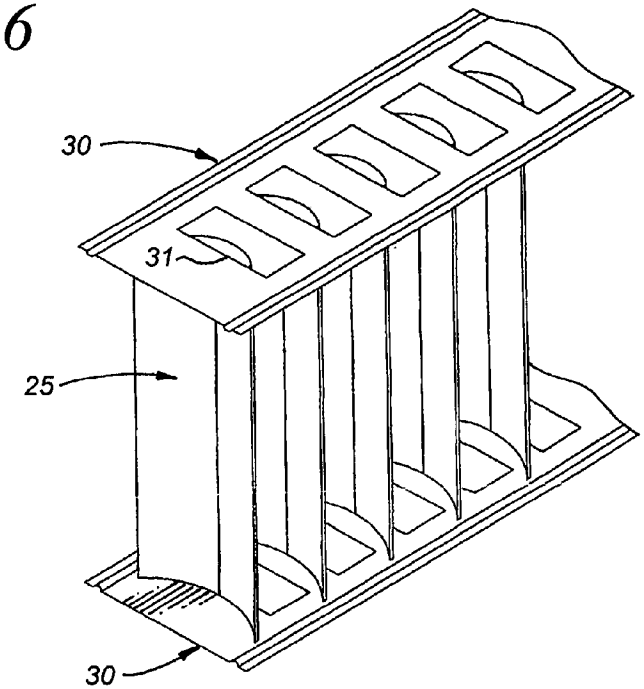

A tongue 34 fully inserted in a vane 25 is illustrated in FIGS. 15 and 17. In FIG. 15, the juncture 50 of wing 65 and portion 63 contacts the inner surface of arcuate portion 26; the juncture 51 of wing 66 and portion 64 contacts the inner surface or arcuate portion 26; and, portion 67 contacts section 49 of vane 25. These three contact points, along with the points at which teeth 37 contact ribs 38 and 39 while being inserted in vane 25 and after being inserted in vane 25, serve to guide tongue 34 into vane 25 and to improve the structural integrity of the vane assembly after each tongue 34 is fully inserted in one end of a vane 25.

Although the number of separate pieces of material used to form a vane 25 can vary as desired, the presently preferred vane configuration utilizes and bends a single piece of material to form a vane 25 that includes one or more ribs 38, 39. The ends or sides of the single pieces of material are wrapped 49 or otherwise secured together. Ribs 38, 39 improve the rigidity and structural integrity of vane 25 and reduce the likelihood that the vane 25 will warp or twist, particularly after a tongue 34 is inserted in each end of vane 25.

In use, vanes 25 and runners 30 are provided. Tongues 34 are slidably inserted in each end of vane 25 in the manner illustrated in FIGS. 16 and 17 to form a vane assembly illustrated in FIG. 17 wherein each tooth 37 extends into, and preferably through, an aperture 41 in an associated rib 38, 39. Each tooth 37, after being inserted in an aperture 41, preferably interlocks in some manner with aperture 41 to make removal of a tooth 37 from aperture 41 difficult. The completed vane system of FIG. 17 is installed in a corner 10 in a HVAC duct assembly in conventional fashion in the manner indicated by dashed lines 101 in FIG. 1 to facilitate and direct air flow through and around the interior 100 of corner 10. Bolts, welds, screws or another other desired means are used to secure the vane system inside corner 10. The shape and dimension of corner 10 can vary as desired. Similarly, the shape and dimension of vanes 25 and runners 30 can vary as desired such that the vane system can be integrated in a selected corner 10 to direct the flow of air through the hollow interior of corner 10.

Having described my invention in such terms as to enable those of skill in the art to make and practice it, and having described the presently preferred embodiments thereof, I claim:

1. A vane system for use in a corner in a duct in a HVAC assembly to direct a flow of air through the corner, the vane system comprising (a) a plurality of unitary vanes (25) each including (i) at least one arcuate wall with a pair of spaced apart generally parallel sides, (ii) an upper end, (iii) a lower end, said sides extending between said upper and lower ends, (iv) at least one rib (38) intermediate said sides, attached to said arcuate wall, extending intermediate said ends generally parallel to said sides, and including a plurality of spaced apart apertures (41) each with a top and a bottom (85), adjacent said wall, formed through said rib, stacked one on top of the other extending in a direction generally parallel to said sides of said vane, and opening in a direction generally perpendicular to said sides;

(b) a first runner (30) connected to said upper ends of said vanes and extending generally perpendicular to said sides and rib:

(c) a plurality of tongues (34) connected to, outwardly extending from, and generally perpendicular to said first runner, each of said tongues (i) extending along and generally parallel to said sides and said rib of a different one of said vanes, (ii) having at least one outwardly projecting tooth (37) extending In a direction transverse and generally perpendicular to said sides and said rib of said vane, and through and interlocked with one of said apertures in said rib of said vane; and, (d) a second runner connected to said lower ends of said vanes and extending generally perpendicular to said sides and rib.

2. A method for constructing a vane system for use in a corner in a duct in a HVAC assembly to direct a flow of air through the corner, the method comprising the steps of (a) providing a plurality of vanes each including (i) at least a first arcuate wall with a pair of spaced apart generally parallel sides, (ii) a first end, (iii) a second end, said sides extending between said ends, (iv) at least one rib (38) intermediate said sides and extending intermediate said ends generally parallel to said sides, said rib including at least one aperture (41) with a top and a bottom (85), formed through said rib, and opening in a direction generally perpendicular to said sides;

(b) providing a first runner (30) to be connected to said first end of each of said vanes to extend generally perpendicular to said sides and said ribs of said vanes;

(c) providing a plurality of tongues (34) each (i) connected to and outwardly extending from and generally perpendicular to said first runner such that when said first runner is connected to said first ends of said vanes said tongue extends along and in a direction generally parallel to said sides and ribs of said vanes, (ii) having at least one outwardly projecting tooth (37) extending in a direction generally parallel to said first runner such that when said first runner is connected to said first ends of said vanes said tooth extends transverse and generally perpendicular to said sides and ribs of said vane, and through and interlocks with and seats in one of said apertures in said rib of one of said vanes, said tooth including an upper canted edge (42) to permits said rib to slide over said tooth in a first direction, and a lower edge (44) that, when said tooth interlocks with one of said apertures in said ribs, extends over said bottom (85) of said one of said apertures to prevent said rib and said one of said apertures from being pulled off said tooth in a second direction opposite said first direction;

(d) providing a second runner to be connected to said second ends of said vanes to extend generally perpendicular to said sides and ribs of said vanes;

(e) connecting said second runner to said second ends of said vanes; and, (f) connecting said first runner to said first ends of said vanes by sliding each of said tongues of said first runner into a different one of said first ends such that (i) said ribs each slide over said upper canted edge of one of said teeth, (ii) and each of said teeth interlocks with and seats in one of said apertures, and (iii) said lower edge of each of said teeth extends over said bottom (85) of one of said apertures.

3. The method of claim 2 wherein each of said vanes includes a second arcuate wall (27) co-terminating with said first wall (26) along said sides (28, 29) to enclose with said first arcuate wall a space through which said rib extends.

4. The method of claim 2 wherein (1) in section (a)

(i) each of said vanes includes a second arcuate wall (27) co-terminating with said first wall (27) along said sides (28, 29) to enclose with said first arcuate wall a space through which said rib extends, and including an inner surface, (ii) said first arcuate wall includes an arcuate inner surface opposed to and spaced apart from said arcuate inner surface of said second wall;

(2) in section (c), each of said tongues (34)is shaped and dimensioned such that when said first runner is connected to said first ends of said vanes said tongue extends along and in a direction generally parallel to said sides and ribs of said vanes and contacts (50, 51, 67) both said inner surface of said first arcuate wall and said inner surface of said second arcuate wall; and, (3) in section (f) each of said tongues contacts both said inner surface of said first arcuate wall and said inner surface of said second arcuate wall of one of said vanes.

5. The method of claim 2 wherein (1) at least one of a pair comprising said rib (38) and said tongue (34)is resilient; and, (2) in section (f), one of said pair resiliently deforms to permit each of said teeth to seat in and interlock with one of said apertures.

* * * * *